United States Patent [19]

Geringer

[11] 4,099,752

[45] Jul. 11, 1978

[54] ELECTRIC LOCK

[76] Inventor: Arthur V. Geringer, 5424 Geyser Ave., Tarzana, Calif. 91356

[21] Appl. No.: 763,023

[22] Filed: Jan. 27, 1977

Related U.S. Application Data

[63] Continuation-in-part of Ser. No. 593,966, Jul. 8, 1975, Pat. No. 4,021,065.

[51] Int. Cl.[2] ..... E05C 1/06

[52] U.S. Cl. ..... 292/144; 70/279; 292/181

[58] Field of Search ..... 292/181, 180, 179, 177, 292/144, 201, 341.16; 70/281, 283, 279; 340/275

[56] References Cited

U.S. PATENT DOCUMENTS

| | | | |
|---|---|---|---|
| 944,896 | 12/1909 | Moore | 292/181 |
| 2,437,777 | 3/1948 | Zajc | 340/275 |
| 2,786,701 | 3/1957 | Povlich | 292/144 |
| 3,751,088 | 8/1973 | Schlage et al. | 70/281 |

*Primary Examiner*—Kenneth J. Dorner

[57] ABSTRACT

An electric lock of a configuration to facilitate its mounting in the limited space of a conventional door structure or door frame structure, in which an actuating solenoid for the bolt is mounted so that its plunger will have an axis of movement in right-angled relation to the axis of movement of the lock bolt. In one embodiment, the lock includes a detent switch operable upon door closure to energize the solenoid for actuation of the bolt to a locking position. In another embodiment, the lock has an associated deadlock which operates automatically to lock the bolt in locking position, and is operable to a non-deadlocking position in response to energization of an associated solenoid. In still another embodiment of the lock, the bolt is normally spring-urged to a locking position, and the bolt actuating solenoid must be energized to maintain the bolt in a retracted non-locking position. Also, in a modified structure provision is made for manually actuating the solenoid operable deadlock to release position.

10 Claims, 9 Drawing Figures

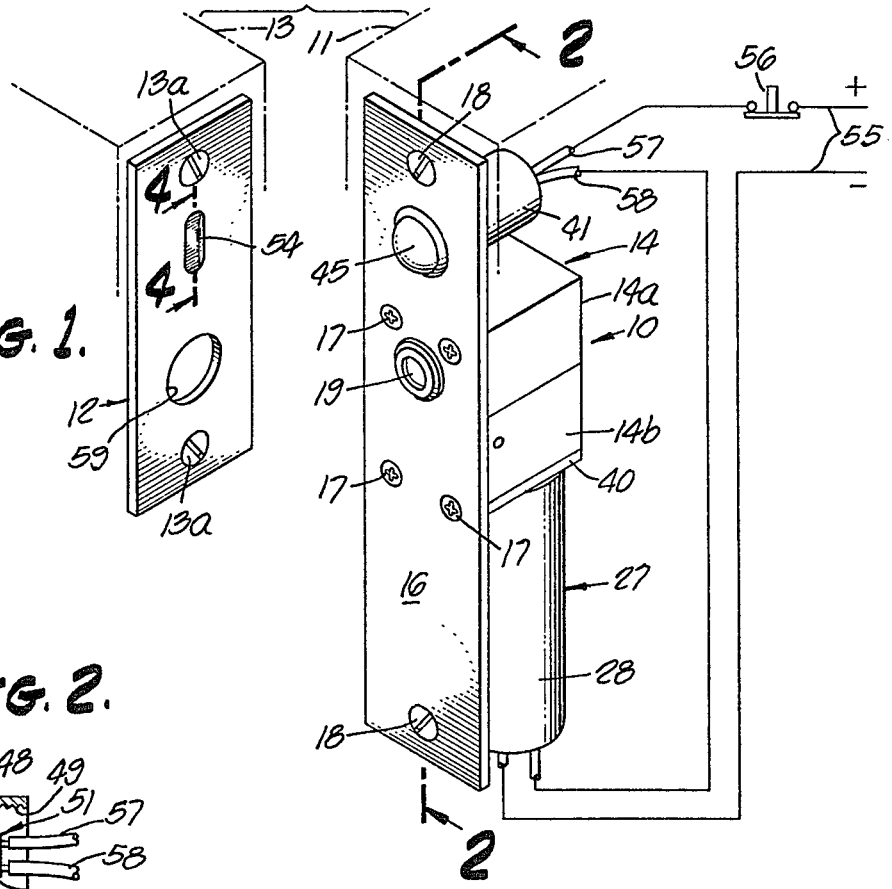
FIG. 1.
FIG. 2.
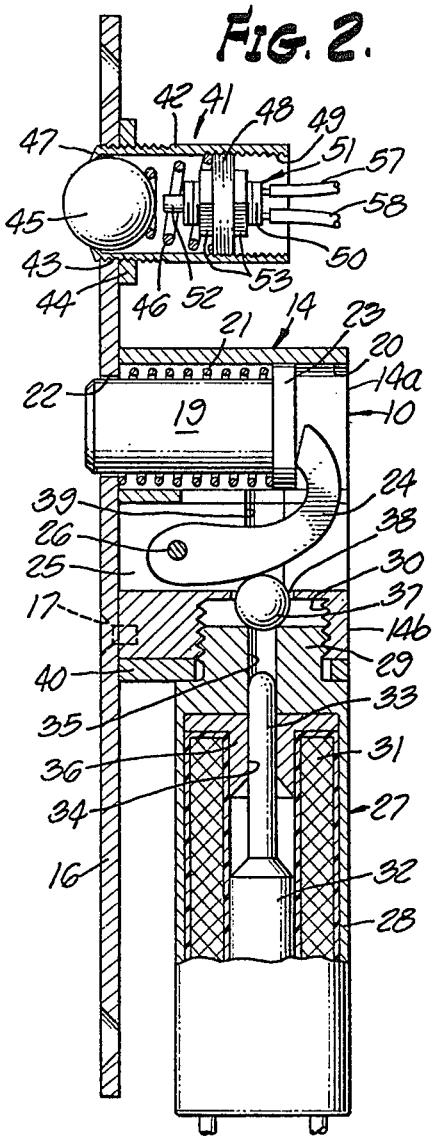
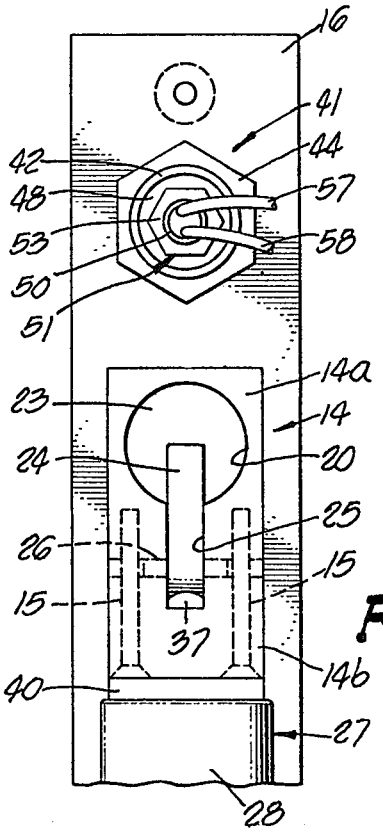
FIG. 3.
FIG. 4.
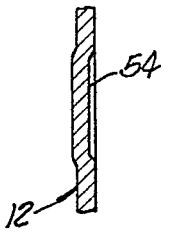

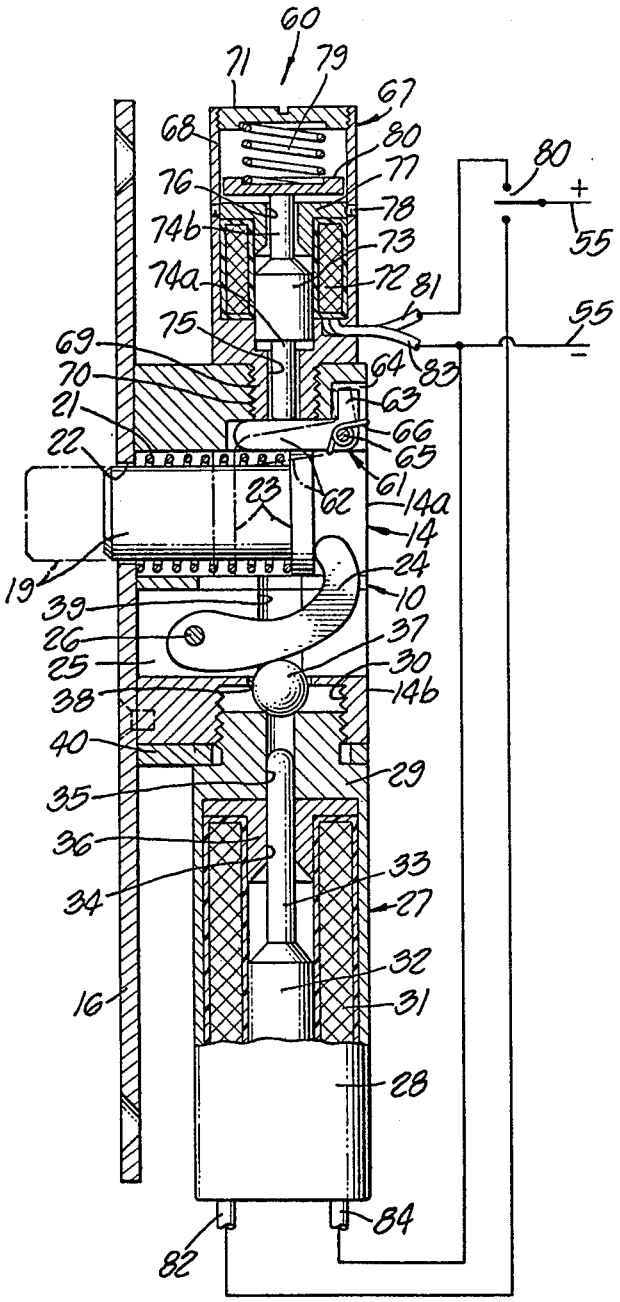
FIG. 5.
FIG. 6.
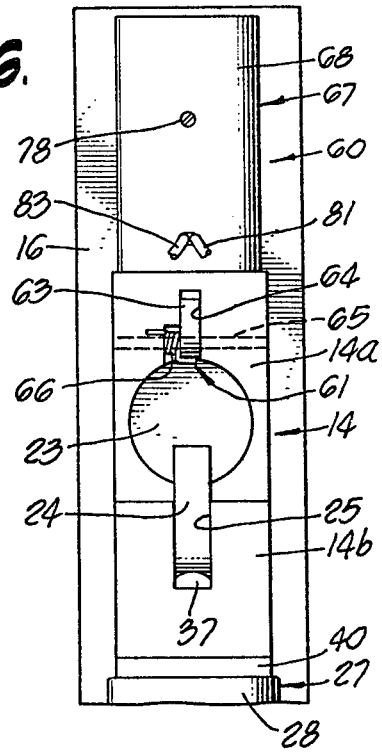
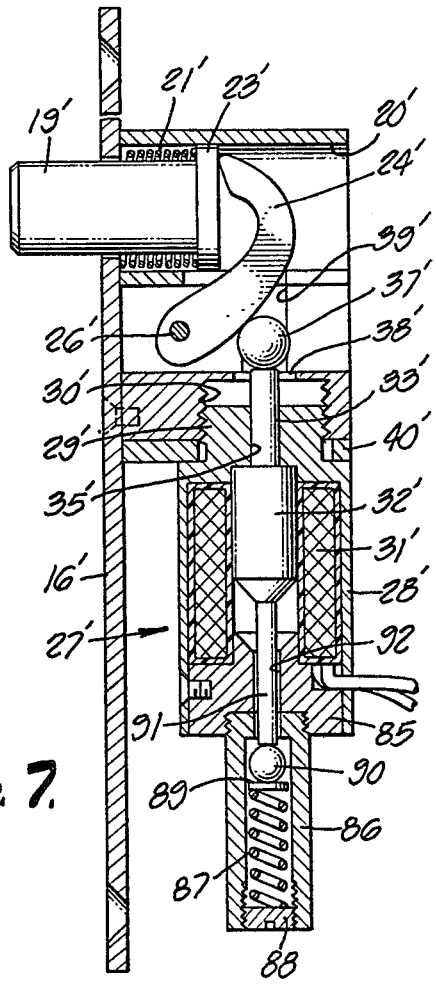
FIG. 7.

ELECTRIC LOCK

This Application is a continuation-in-part of my pending prior Application, Ser. No. 593,966, filed July 8, 1975 and now U.S. Pat. No. 4,021,065.

BACKGROUND OF THE INVENTION

The present invention relates generally to door locks.

It has been known generally heretofore to provide locking mechanism with reciprocably mounted bolts which are operable by in-line solenoids. Such arrangements are shown in the U.S. Pat. of H. K. Price, No. 3,166,144, dated Jan. 19, 1965, and in my U.S. Pat. Nos. 3,751,086, dated Aug. 7, 1973 and 3,872,696, dated Mar. 25, 1975.

Such in-line arrangements are not adapted for use in lock installations, in which the lock is to be mounted, for example, in a conventional narrow door stile or frame member, wherein the depth limitation is insufficient to receive the in-line mounted bolt and rearwardly mounted solenoid.

In its broad concept, the present invention overcomes the foregoing problem by providing an electric lock unit of unique configuration, which may be readily mounted in either a horizontally or vertically extending narrow door stile or frame member. This is made possible by changing the solenoid from an in-line position with respect to the lock bolt to a position in which the operating axis of the solenoid is in right-angled relation to the bolt operating axis. Thus, the depth dimension of the lock structure is minimized to the extent that it may be readily accommodated by a narrow door stile or frame member.

SUMMARY OF THE INVENTION

The present invention relates generally to an improved locking mechanism for mounting in a door or door frame, and more specifically to an electrically actuated locking mechanism having a configuration such that it may be mounted in a narrow door stile or frame member.

One object of the herein described invention is to provide an electrically actuated lock structure having a solenoid actuated reciprocable bolt, in which the cooperative relationship of the components is such as to enable the lock structure to be mounted in either a horizontally or vertically extending conventional narrow door stile or frame member.

A further object is to provide an electric lock in which the bolt operating axis and the operating axis of a solenoid for actuating the bolt are in right-angled relation.

A further object resides in the provision of an electric lock according to the preceding object, which embodies unique connection means between the bolt and a solenoid plunger for actuating the same.

Another object is to provide an improved electric lock in which a reciprocable bolt is normally spring-urged to a locking position and is coupled with a solenoid operable upon being energized to move the bolt to a non-locking position.

Still another object is to provide an electric lock with unique deadlocking means which are automatically urged to a deadlocking position with respect to the locking bolt, and which are selectively electrically or manually actuatable to a non-deadlocking position.

Still another object is to provide an improved electric door lock in which a reciprocable bolt is normally urged to a locking position, and in which the bolt is actuated to a non-locking position by means capable of being electrically energized in response to the actuation of associated switch means by movement of the door to a closed position.

Further objects of the invention will be brought out in the following part of the specification, wherein detailed description is for the purpose of fully disclosing the invention without placing limitations thereon.

BRIEF DESCRIPTION OF THE DRAWINGS

Referring to the accompanying drawings, which are for illustrative purposes only:

FIG. 1 is a perspective view illustrating the cooperative relationship of an electrically actuated locking mechanism mounted on a door frame, and a strike plate mounted on the door, according to the present invention;

FIG. 2 is a vertical section of the lock and an associated detent control switch, taken substantially on line 2—2 of FIG. 1;

FIG. 3 is a fragmentary rear elevational view of the upper end portion of the same;

FIG. 4 is a fragmentary section showing details of the detent recess, taken substantially on line 4—4 of FIG. 1;

FIG. 5 is a vertical sectional view, partly in section, of a modified embodiment which includes an associated deadlocking means which are operable to non-deadlocking position by an energizeable solenoid;

FIG. 6 is a fragmentary elevational rear view of the upper end portion of the embodiment shown in FIG. 5;

FIG. 7 is a vertical sectional view of a further embodiment in which the bolt is normally urged to locking position, and moved to non-locking position upon energization of an operating solenoid;

DETAILED DESCRIPTION OF THE SEVERAL EMBODIMENTS

Figure 8:
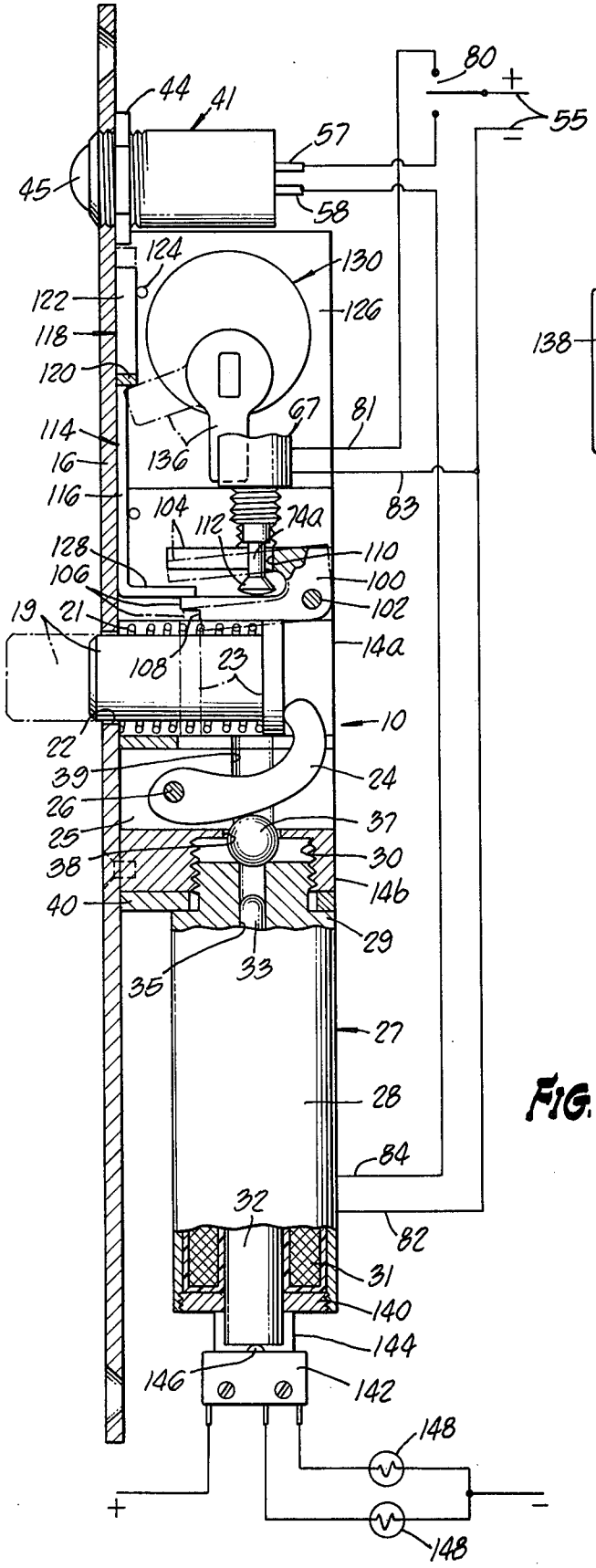
FIG. 8 is a vertical sectional view of another lock embodiment which includes a detent control switch, and deadlocking means selectively releasable by manual or solenoid means.

For illustrative purposes, there is shown in FIG. 1 an electric door lock, as generally indicated at 10, this lock being mounted on a door frame 11. The lock as thus mounted is arranged for cooperative association with a strike plate, as generally indicated at 12, mounted on a door 13, as by retaining screws 13*a*. According to the present invention, however, it is to be understood that the lock may be mounted on a vertical narrow door stile or associated fixed vertical frame member, or on a horizontal narrow door rail or associated fixed horizontal frame member.

Referring more specifically to FIGS. 1 and 2, the electric lock in this embodiment comprises a housing 14 which is fabricated of two sections, an upper section 14*a* and a lower section 14*b*, which are secured together as by means of screws 15, as best shown in FIG. 3. This housing is supported as a unit on a face plate 16 by means of appropriate mounting screws 17, the face being normally secured with its outer surface flush with the edge surface of the door frame 11 or the narrow stile member, depending upon the installation, as by retaining screws 18.

As best shown in FIG. 2, the locking mechanism comprises a cylindrical bolt 19 which is guidingly supported for reciprocable axial movement within a cylindrical bore 20 formed in the upper housing section 14*a*. The bolt movement axis is in right-angled relation with respect to the longitudinal axis of the face plate 16 and the axis of the narrow stile door frame in which the lock is mounted. The bolt is normally urged by a surrounding coiled spring 21 to a retracted non-locking position in which the outermost end of the bolt is positioned within an opening 22 of the face plate.

One end of this spring bears against the inner marginal surface of the face plate opening 22, and the other end of the spring bears against a circumferentially projecting end flange 23.

For moving the bolt 19 from a retracted non-locking position to a projected locking position, an angle lever 24 is swingably mounted within a depending slot 25 formed in the housing section 14*a* and 14*b* and having its uppermost end in communication with the cylindrical bore 20. One end of the angle lever 24 is supported on a pivot 26, while the other end of the lever is arranged to bear against the innermost end of the bolt 19 in a manner such that when the angle lever is pivotally swung in a counterclockwise direction, the bolt 19 will be moved towards its projecting locking position.

A solenoid actuator, as generally indicated at 27, is provided in this case for moving the angle lever 24 in a direction to move the bolt 19 into a locking position. As shown, this solenoid actuator is contained within a tubular housing structure 28 which is provided with a threaded nipple 29, which permits the attachment and detachment of the solenoid actuator by threaded engagement with a threaded recess 30 in the lower housing section 14*b* so as to dependingly extend therefrom.

The solenoid actuator, in this case, includes a solenoid coil 31 which operatively surrounds a solenoid plunger 32, this plunger normally occupying a position at the lowermost end portion of the coil, when the coil is deenergized. The uppermost end of the plunger 32 engages the lowermost end of an elongate pin 33 which is reciprocably movable within registered bore passages 34 and 35 respectively formed in a coil end bushing 36 and the nipple 29. At the uppermost end of the bore passage 35, a ball 37 of appropriate material, such as nylon, is positioned in the upward path of movement of the pin 33. This ball normally seats on the uppermost end of the bore passage 35 and is adapted to be moved upwardly by the pin through an opening 38 in the bottom of the threaded recess 30 against the angle lever 24 so as to swing the lever in a direction to move the bolt towards its locking position. During this movement of the ball 37, it is guided by means of guiding grooves 39 formed respectively on the opposite side walls of the slot 25.

At the time of attaching the solenoid actuator 27, a spacer plate 40 is placed around the nipple 29, this plate in the mounted position of the solenoid actuator serving to prevent access to the heads of the screws 15.

It will be appreciated from the foregoing description that the electric lock 10 is arranged to be activated to a locking position by energization of the solenoid actuator 27 through appropriate switching means which may be manually controlled or automatically accomplished in response to movement of the associated door 13 into a closed position. For automatic closure, the electric lock 10 is shown in FIGS. 1 and 2 as being associated with a spring detent control switch, as generally indicated at 41. This switch is embodied in a cylindrical casing 42 which is threaded at one end for threaded mounting engagement with a threaded second opening 43 in the face plate 16 in spaced relation above the opening 22. Preferably, the casing 42 is further retained by a lock nut 44 carried by the threaded end of the casing. A detent ball 45 is movably supported within the threaded end of the casing and is urged by a coiled spring 46 towards a position in which a portion of the ball projects beyond the outer surface of the face plate 16, the ball in this position being engaged with an end abutment flange 47. The inner end of this spring bears against a peripherally threaded disc member 48 having threaded adjustable engagement with internal threads 49 at the inner end of the casing 42. The disc member 48 centrally mounts an externally threaded cylindrical casing 50 of a conventional switching unit, as generally indicated at 51, this switching unit having normally open contacts, not shown, adapted to be moved to closed position in response to the axial movement of a contact actuator element 52 having its outermost end normally in spaced relation to the ball 45. This spacing is adjustable by means of lock nuts 53, threadedly engaged with the casing 50 and respectively positioned on the opposite sides of the disc member 48. With this arrangement, it will be apparent that upon closure of the door 13, the ball 45 will be moved inwardly by the strike plate 12, and upon contact of the ball with the contact actuator element 52 will close the contacts of the switching unit. In the closed position of the door, the ball 45 will releasably seat in a recess 54 formed in the strike plate 12.

As shown in FIG. 1, an energizing circuit is provided for the spring detent control switch and the solenoid actuator from a suitable electric source, as indicated at 55. One side of this source is connected through normally closed contacts of a control switch 56 to one terminal 57 of the spring detent control switch 41. The other side of the electrical source is connected through the terminals of the solenoid coil 31 to the other terminal 58 of the spring detent control switch. With this arrangement, it will be readily apparent that upon closure of the door 13, the detent ball 45 will actuate the normally open contacts of the switching unit 51 into closed position and thus complete the circuit to the solenoid coil 31, whereupon the solenoid actuator will function to move the bolt 19 into a locking position in which the bolt end will extend into a bolt receiving opening 59 formed in the strike plate 12, and adapted in the closed position of the door to be axially aligned with the axis of movement of the bolt 19. The solenoid actuator 27 may be deenergized to permit unlocking of the lock and opening of the door 13, simply by moving the control switch 56 into an open position of its contacts.

Referring to FIG. 5, there is shown an electric lock 10 having the same basic construction as that shown in FIGS. 1 and 2, except that the electric lock in this embodiment is provided with a deadlocking mechanism, as generally indicated at 60. This deadlocking mechanism comprises a deadlocking lever 61 of L-shaped configuration with an elongated leg 62 which is positioned generally above the end flange 23, and a substantially right-angled short leg 63 extending generally in an upward direction, as shown. This lever is supported within a slot 64 upon a pivot 65 for limited swinging movement between a non-deadlocking position as shown in full lines and a deadlocking position as shown in phantom lines, wherein the deadlocking lever engages behind the end flange 23, when the bolt is in locked position. The deadlocking lever is urged towards non-deadlocking position by means of a coiled spring 66 around the pivot 65, one end of this spring being connected with the elongated leg 62, and the other end being anchored in an associated portion of the housing adjacent the slot 64. Swinging movement of the deadlocking lever towards its deadlocking position is limited by the abutment of the leg 63 against an adjacent wall of the slot 64.

Operation of the deadlocking mechanism is controlled by a solenoid actuator 67 which is contained within a cylindrical housing 68 having a threaded end nipple 69 for threaded attaching engagement with a threaded opening 70 at the upper end of the housing section 14*a*. The opposite end of the housing 68 is closed by a removable end closure 71. Within the housing 68, a solenoid coil 72 coaxially surrounds a solenoid plunger 73, this plunger being provided with axially projecting stems 74*a* and 74*b* respectively. The stem 74*a* is guidingly supported within a bore 75 in the nipple 69. The stem 74*b* is guidingly supported in a bore 76 of a bushing member 77 fixedly retained at the upper end of the solenoid coil by means of retaining screws 78. As shown, the lowermost end of the stem 74*a* bears against the leg 62 of the deadlocking lever, and is normally urged in a direction towards the leg by a compression coiled spring 79, one end of this spring bearing against a washer 80 interposed between the spring and the adjacent end of the stem 74*b*, the other end of the spring bearing against the end closure 71.

As thus arranged, the leg 62 is retained in its non-deadlocking position by the end flange 23, when the bolt 19 is in non-locking position as shown in full lines in FIG. 5. Upon actuation of the bolt 19 to a locking position, the bolt moves to the position shown in phantom lines, and at this position the flange 23 assumes a position which permits the leg 62 to pivot in a counterclockwise direction to a position in which its end is behind the flange 23. Movement of the leg 62 to a deadlocking position results from the action of the spring 79 which is of sufficient force to overcome the force of spring 66 and its tendency to move the deadlocking lever in a clockwise direction about its pivot. In order to release the deadlock, it is only necessary to energize the solenoid actuator 67. Energization of the solenoid coil of the actuator operates to move the solenoid plunger 73 in a direction against the force of spring 79. As a result of this movement, the leg 62 of the deadlocking lever is released for movement from a deadlocking position to a non-deadlocking position by virtue of the action of spring 66. The bolt 19 is thus freed for movement under the action of spring 21 to a non-locking position.

In the embodiment shown in FIG. 5, the solenoid actuators 27 and 67 are selectively energizable from the electrical source 55. For this purpose, one side of the electrical source is selectively connectible through a double throw control switch 80 with a terminal 81 of the coil 72 or the terminal 82 of the solenoid coil 31. The other side of the electrical source is connected directly to the terminals 83 and 84 of these solenoid coils.

The embodiment shown in FIG. 7 differs primarily in its operation from that of the lock shown in FIG. 2 in that the bolt is normally urged to a locking position and the solenoid actuator must be energized to permit the bolt to move to a non-locking position. In the embodiment of FIG. 7, similar elements to those of the previously described embodiments have been indicated with primed numbers. More specifically, the solenoid actuator 27' has the housing structure 28' closed at its lowermost end by a guide bushing 85 which supports an attached spring housing 86 containing a compression coiled spring 87. One end of this spring bears against a threadedly adjustable housing end closure disc member 88, while the other end of the spring bears against a spring washer 89 having engagement with a ball member 90 interposed between the washer and the adjacent end of a pin 91 supported for reciprocal movements in a bore passage 92. The uppermost end of the pin 91 bears against one end of the solenoid plunger 32'. The opposite end of the solenoid plunger engages with pin 33' which acts through the ball 37' to move the angle lever 24' in a counter-clockwise direction under the urging of spring 87. The spring 87 is designed to have an effective force greater than that of spring 21' in order that the bolt 19' will be normally moved to its locking position, when the solenoid actuator 27' is deenergized. Upon being energized, the solenoid acts to move the plunger 32' downwardly against the pressure of spring 87, thus permitting the spring 21' to move the bolt 19' to a non-locking position.

Figure 9:
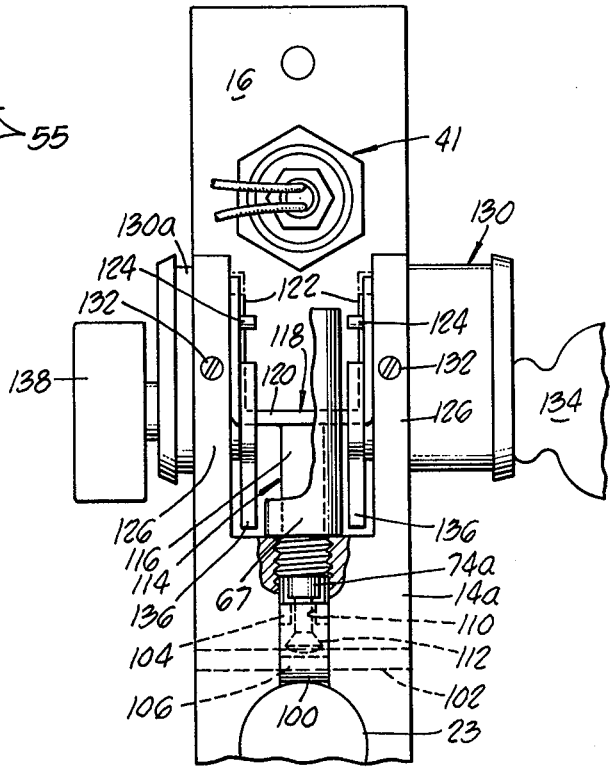
FIG. 9 is a fragmentary elevational rear view of the upper end portion of the embodiment shown in FIG. 8.

Referring further to FIGS. 8 and 9, there is illustrated a further embodiment of the invention, which differs from the previously described embodiments primarily in that provision is made for manually actuating the deadlocking means, and in the provision of unique lock-position indicating means. More specifically, the deadlocking means in this case comprises an elongate deadlock lever 100 which is supported at one end on a pivot member 102 for vertical swinging movement, and at its opposite end is formed to provide an upper finger 104 and lower finger 106 in spaced apart relation. The lower finger is normally slidably engaged by the innermost end of the end flange 23 of the bolt 19, but upon movement of the bolt to projected position, the lower finger is adapted to swing downwardly into a deadlocking position in which the adjacent portion of the end flange will be seated in a notch 108 at the end of the lower finger.

Provision is made for selectively electrically actuating the deadlock lever to a non-deadlocking position, and for manually actuating the lever to such non-deadlocking position. For the electrical actuation, the previously described solenoid 67 has in this case a plunger stem 74*a* which extends downwardly through a vertical slot 110 formed in the upper finger 104. This stem is provided at its end with a projection in the form of a headed portion 112 which is disposed in the space between the upper finger 104 and lower finger 106. As thus arranged, it will be evident that upon energization of the solenoid 67, upward movement of the plunger and connected stem 74*a* will operate through the head portion 112 to swing the deadlock lever 100 to a released or non-deadlocking position with respect to the bolt 19, and that in this released position of the deadlock lever, the bolt will be free to move under the urging force of the spring 21 to a retracted or non-locking position as shown in full lines in FIG. 8.

For effecting manual operation of the deadlocking lever to its released position, an actuating member 114 is supported for vertical sliding movement on the rear face of the face plate 16. This actuating member may vary as to construction, but is shown as comprising an elongate strap 116 which carries a connected U-shaped yoke 118 at its uppermost end, this yoke having a bridging portion which is integrally formed at its ends with upstanding side arm portions 122 which are held in sliding relation with the face plate 16 by means of guide pins 124. These guide pins are respectively anchored in spaced apart upwardly extending end extensions 126 which are shown as being integrally formed with the upper housing section 14*a*. These extensions provide an intervening space within which the solenoid 67 is mounted. At its lower end, the strap 116 is laterally deflected to provide a right-angled end projection 128 which extends into the space between the upper finger 104 and lower finger 106 of the deadlock lever. With this arrangement, it will be apparent that the actuating member 114 is free to move downwardly under gravity forces along with the downward swinging movement of the deadlock lever 100 into its deadlocking position, and that if means are provided to raise the actuating member 114, the deadlock lever 100 will be swung in an upward direction to its non-deadlocking position.

As best shown in FIG. 9, manual operating means may be provided on the opposite sides of the frame containing the lock mechanism for raising the actuating member 114 and moving the deadlock lever 100 to a non-deadlocking position.

For example, the actuating means may comprise a conventional key-cylinder assembly 130 which is supported and retained in an operative position in the adjacent end extension 126 as by a retaining screw 132. This key-cylinder is actuatable by means of an appropriate key 134, and by means of which the key-cylinder may be rotated to swing an associated cam arm 136 from a disengaged position as shown in full lines in FIG. 8 into the phantom line position in which it engages under one end of the bridging portion 120 and by continuing the swinging movement of the cam will operate to raise the actuating member 114 so as to release the deadlock lever 100. Movement of the cam arm in an opposite direction will release the actuating member 114 for downward movement when the deadlock lever 100 moves into a deadlocking position.

If desired, a similar key-cylinder assembly may be mounted on the opposite side of the lock mechanism. However, as illustrated in FIG. 9, there is mounted in this case an assembly 130*a* in which the cam arm 136 is rotated by means of a knob member 138. In this case, the cam arm is movable into engagement with the opposite end of the bridging portion 120.

As in the case of the embodiment shown in FIG. 5, the arrangement of FIG. 8 provides for the selective energization of the solenoid actuators 27 and 67 by manipulation of the control switch 80. The control in FIG. 8 however differs in that the control switch 41 is electrically in circuit with the coil 31 of the solenoid actuator 27. This provides a desirable operating feature in that the bolt 19 cannot be operated into its projecting position so long as the door is in an opened position. The door must be closed in order to permit closure of the contacts of the switch 41 in order to complete the energizing circuit of the solenoid 27 and permit actuation of the bolt 19 to its projecting position.

As further shown in FIG. 8, means are provided in this case for visually indicating the operative position of the bolt 19. For this purpose, the lowermost end of the tubular housing 28 is provided with a threaded closure plug 140 which is centrally apertured to permit the lower end of the plunger 32 to project therethrough. A conventional microswitch assembly 142 is mounted to the closure plug 140 by means of a bracket 144 in an operative position in which the switch actuating member 146 will subtend and be positioned in the path of movement of the end face of the plunger 32. Thus, when the bolt 19 is in a retracted position, the actuating member 146 will close the switch contacts to complete an energizing circuit for one of the indicating lamps 148, and when the plunger 32 is raised to move the bolt 19 to a projected position, the actuating member will be moved to an operating position in which contacts will be closed to complete an energizing circuit for the other indicating lamp 148.

From the foregoing description and drawings, it will be clearly evident that the delineated objects and features of the invention will be accomplished.

Various modifications may suggest themselves to those skilled in the art without departing from the spirit of my invention, and, hence, I do not wish to be restricted to the specific form or forms shown or uses mentioned, except to the extent indicated in the appended claims.

I claim:

1. In an electric door lock which includes an elongate housing adapted for mounting in a door or frame member, a bolt supported in said housing for movement between a projected locking position and a retracted non-locking position, means normally urging said bolt toward its retracted position and solenoid means for actuating said bolt to a projected locking position; improved deadlocking means automatically operable to releasably lock said bolt in said locking position, said deadlocking means comprising:

an elongate lever member pivoted at one end in said housing for limited vertical swinging movement between deadlocking and non-deadlocking positions with respect to said bolt, said lever member being formed at its other end to provide spaced upper and lower finger portions, said lower finger portion being positioned to engage behind the inner end of said bolt upon movement of said bolt to its projected locking position;

means urging said member to its deadlocking position in response to movement of said bolt to its locking position; and means for releasing said deadlocking member, comprising a movably mounted actuating member having a lateral projection extending between said upper and lower finger portions, whereby upon movement of said actuating member in an upward direction, the deadlocking member will be swung upwardly on its pivot to disengage said lower finger portion with respect to said bolt to permit movement of said bolt by said urging means to said retracted position.

2. An electric lock according to claim 1, in which said means for releasing said deadlocking member comprises a solenoid mounted in said housing and having a plunger connected with said upper finger of the deadlocking member and adapted upon energization of the solenoid to move the deadlocking member to its non-deadlocking position.

3. An electric lock according to claim 2, including switching means selectively operable to connect said bolt actuating solenoid means to an electric source, and to connect said deadlocking solenoid with said electric source.

4. An electric lock according to claim 1, in which said means for releasing said deadlocking member comprises manually operable means coupled to said movable actuating member in said housing and operable in one direction to move the deadlocking member to its non-deadlocking position.

5. An electric lock according to claim 4, in which said manually operable means further includes a rotatable member supported for actuation from the exterior of said housing.

6. An electric lock according to claim 4, in which said manually operable means are key-actuated.

7. An electric lock according to claim 4, in which a plurality of manually operable means are associated with said movable actuating member and are selectively and independently operable to move said actuating member in said deadlock releasing direction.

8. An electric lock according to claim 7, in which said movable actuating member is supported on said housing for vertical raising and lowering sliding movements, said actuating member having a yoke at its upper end engageable respectively by said plurality of manually operable means.

9. An electric lock according to claim 1, in which said upper finger has a longitudinal generally vertical slot; and said projection is formed on an end portion of a solenoid plunger extending downwardly through said slot.

10. In an electric door lock which includes an elongate housing adapted for mounting in a narrow door or frame member with the longitudinal axis of the housing aligned with the longitudinal axis of the member, said housing having a face plate and two oppositely facing sidewalls perpendicular to the faceplate, a bolt supported in said housing for movement along a bolt axis perpendicular to the face plate between a projected locking position and a retracted non-locking position, a deadlocking member supported in the housing for movement between a deadlocking position locking the bolt in its projected position and a bolt releasing position and urged yieldingly toward its deadlocking position, means for yieldingly urging the bolt toward its retracted position, and solenoid means supported in the housing on one side of the bolt axis for actuating the bolt to said projected position; improved means for actuating the deadlocking member to its bolt releasing position, comprising:

second solenoid means supported in the housing on the other side of the bolt axis in spaced relation to the face plate and coupled to the deadlocking member, two actuating members supported between said second solenoid means and the respective housing sidewalls for rotation about parallel axes perpendicular to the sidewalls, said actuating members being manually rotatable from outside the housing on opposite sides thereof, and an elongated coupling member supported within the housing for longitudinal sliding movement parallel to said face plate between the face plate and said second solenoid means, one end portion of the coupling member operatively engaging the deadlocking member and the other end portion of the coupling member carrying two laterally spaced abutments which are independently engageable by the respective actuating members.

* * * * *